US006913177B2

(12) United States Patent
Steiner

(10) Patent No.: US 6,913,177 B2
(45) Date of Patent: Jul. 5, 2005

(54) BLANKING METHOD AND DEVICE INTO A CUTTING MACHINE FOR PLATE ELEMENTS

(75) Inventor: Jean-Pierre Steiner, Crissier (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 10/661,255

(22) Filed: Sep. 12, 2003

(65) Prior Publication Data

US 2004/0050225 A1 Mar. 18, 2004

(30) Foreign Application Priority Data

Sep. 12, 2002 (CH) ..... 1548/02

(51) Int. Cl.[7] ..... B26F 3/00
(52) U.S. Cl. ..... 225/2; 225/96.5; 225/104
(58) Field of Search ..... 225/20, 96.5, 104, 225/2; 83/137, 123

(56) References Cited

U.S. PATENT DOCUMENTS 2,548,370 A 4/1951 Hedstrom et al.
3,303,979 A 2/1967 Lang
5,322,202 A * 6/1994 Pelletier ..... 225/97
5,386,751 A 2/1995 Dylla et al.
5,409,368 A 4/1995 Heiskell et al.
5,443,195 A * 8/1995 Sinn ..... 225/104
5,474,219 A * 12/1995 Mano ..... 225/2
5,810,233 A 9/1998 Varidel
5,906,702 A * 5/1999 Crawford, Jr. et al. ..... 156/251
5,996,456 A * 12/1999 Streck ..... 83/123
6,273,312 B1 * 8/2001 Yamaguchi et al. ..... 225/96

FOREIGN PATENT DOCUMENTS

CH 682651 10/1993
DE 10 44 579 B 11/1958

* cited by examiner

*Primary Examiner*—Charles Goodman
(74) *Attorney, Agent, or Firm*—Ostrolenk, Faber, Gerb & Soffen, LLP

(57) ABSTRACT

Blanking device in a cutting machine for plate elements in a sheet, such as a paper, cardboard or plastic sheet, which had been previously cut into several blanks that are maintained together in the sheet by a number of nicks: a lower tool, an upper tool movable toward the lower tool, a plurality of telescopic pressing devices below the upper tool and outward of the blanks, and plurality of punches aimed to remove blanks from the sheet during vertical motion of punches. The punches each have a suction cup linked to a vacuum or pressure source able to generate a change in the air pressure inside of the suction cup by a distribution network. The suction cups hold the blanks starting before separation of the blanks from the punches. A method to bring the device into operation in the above sequence of operations.

16 Claims, 2 Drawing Sheets

BLANKING METHOD AND DEVICE INTO A CUTTING MACHINE FOR PLATE ELEMENTS

BACKGROUND OF THE INVENTION

The present invention relates to a blanking method and device in a plate elements cutting machine, for example, for cutting paper, cardboard or plastic sheets.

Manufacture of such sheets is generally executed within a production line mainly made up of a cutting station, a waste stripping station and a blanking and delivery station. Sheets are brought successively from one station to the other by a gripper bar, mounted on chain members, that seize the front side of the sheet. At each station, the chain members are stopped and each sheet is liable to a transformation constituting a new stage in the manufacturing process.

It is possible to produce, for example, packing boxes, labels and any other articles that are generally preprinted from each sheet. Developed opened during the manufacturing process, these articles are ordinarily called blanks by professionals.

These sheets are first cyclically introduced one after the other in a platen press, which will cut as many blanks as allowed by the surface capacity of the sheet. In order to avoid the sheet falling into pieces once cut up, all blanks are designed to be held together by points of attachment or small material bridges, sometimes called nicks, obtained by (non cutting) mortises realized in the cutting rules of the press tool.

Despite the planned disposition of the blanks over the surface of the sheet, it is generally not possible to avoid all production of interstitial losses. It is thus necessary to pass each of these sheets to another station, called waste stripping station, in order to withdraw all the undesired parts, by nipping between several stripping members. After this process, the sheet is then brought by a gripper bar to a blanks separating and delivering station, where these blanks are precisely unfastened from each other and are carefully piled up on a palette to form as many piles as the number of blanks of a sheet. Finally, the residual sheet, or skeleton, which includes the sheet's front side, is released by the gripper bar in an exit station.

The present invention is used in the blanks separating station of the machine.

An upper mobile tool and a lower fixed tool are generally used in a blank separating machine. The upper tool is comprised of a series of punches and the lower tool is comprised of a board having apertures located face to face with the punches. In a downwards vertical motion, the upper mobile punches press on all blanks at once and into the apertures of the lower tool, thus breaking the points of attachment that linked each blank to the remaining sheet. The separating tools have therefore to fit with the form and disposal of the blanks of each new series of sheets to be manufactured. Generally, the punches are strip aligned with regards to the cutting lines of the press, on a basis plate fixed on an upper tool rack frame of the blank separating machine. On the lower tool, there is a corresponding opening or a mesh under and opposite to each punch. The tool is made up of rods defining the meshes, or of largely perforated board.

Patents CH682651 and EP763407 provide more details of such a device that works very well for big or medium size blanks. But, when it is necessary to separate small size or small with blanks, such as strips, these blanks tend to pivot or to turn over when they are released from the sheet. As a consequence, they cannot be piled up properly and that process becomes uncertain and possibly wrong. When the surfaces of the blanks are important enough, which is generally the case in packing manufacture, these blanks naturally fall floating and piling up correctly on the palette. It is observed that the ratio between the height of fall and the blank surface is small enough to avoid the blanks turning over. But, this height of fall, which is generally around 65 mm high, can hardly be reduced due to the various size constraints, either because of the high density of mechanical pieces in the machine or because it is necessary to provide a defined space between the tools, for example in case of a jam, in order to be able to easily withdraw the damaged sheets.

The problem occurring with wrong piling of blanks is particularly apparent when these blanks are produced from a plastic sheet. Indeed, this kind of material often confers a good elasticity to the blanks while bent. Now, this is precisely the case in the blank separating process. When a punch presses on the blank, these blanks bend more and more until the sudden break up of the attachment points. At that moment, the blank is hurled down at a very high speed under the release effect that is abruptly produced when the material bridges separate. The blank propelling speed is far greater than the punch movement so that the falling of the blank gets completely out of control. It has also been observed that the "spring effect" of the release is more apparent because the material used resists the rupture (as is the case with plastic as compared with cardboard). The depth (around 0.2 to 0.6 mm) and geometry of the blank also increase this reaction especially when blanks are particularly narrow and long and/or the cuts are in small strips form, for example.

Another disadvantage is observed when the attachment points do not break all at the same time while the punch goes through the lower tool. This often arises when the processed blanks are made up of a low depth (typically between 40 $\mu$m and 0.1 mm) synthetic substance, such as polypropylene. Thus, if all the attachment points of a same side break up correctly but not the ones on the opposite side, the still attached blanks could not be completely removed and would remain hanging under their sheet by the remaining points of attachment. In this situation, either a jam would occur in the machine or a disarrangement in the piling would occur when the blank eventually falls at the withdrawal time of the remaining sheet.

SUMMARY OF THE INVENTION

The present invention has the object of avoiding the aforesaid disadvantages through a blanking method and device allowing the control of the falling of the blanks in order to avoid any kind of turning over or any other inopportune disturbance during the piling up process. For this purpose, the present invention uses punches equipped with suction cups allowing the blanks to be seized before the beginning of the blanking operation and to maintain the blanks to be held, by suction, until the punches completely cross the matrix and have moved down preferably as close as possible to the top of the pile of blanks. This device offers the advantage of allowing controlling of the fall of all the blanks as long as possible until the punches release them and the punches then move up again to begin a new cycle of blanking.

For this purpose, the present invention relates to a blanking device, and an implementing method for the device.

Other features and advantages of the present invention will become apparent from the following description of the invention which refers to the accompanying drawings.

DESCRIPTION OF PREFERRED EMBODIMENTS

Figure 1:
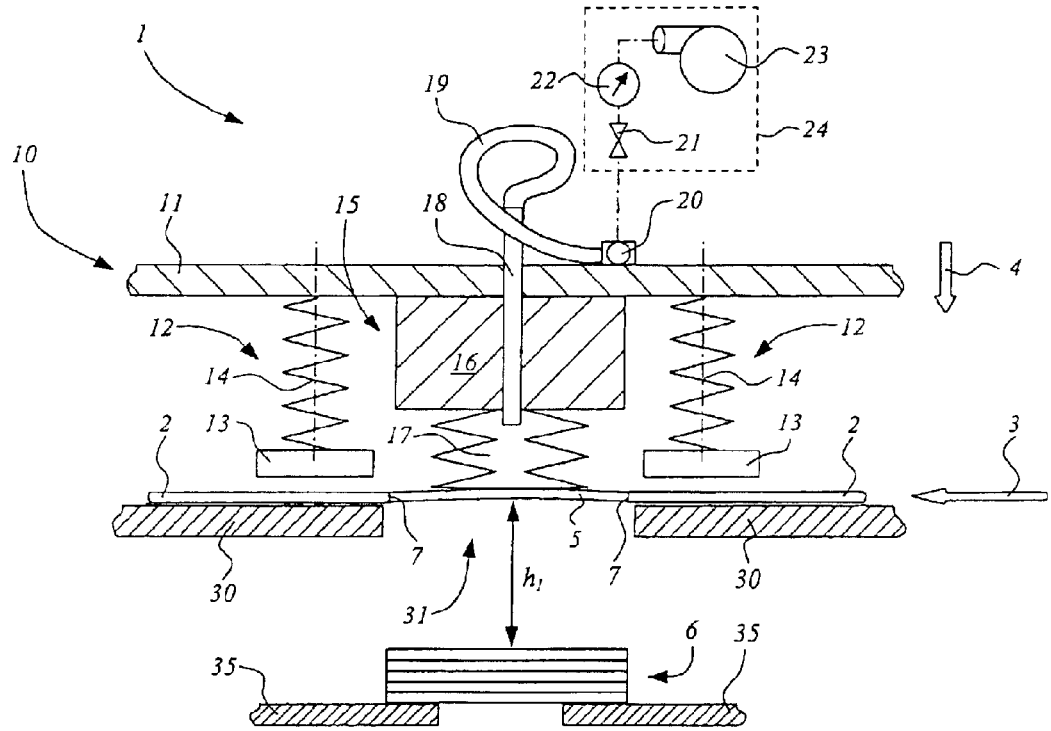
FIG. 1 is a schematic, partial, cross sectional view of the blanking device of the present invention, in a first situation at the beginning of the blanking process cycle.
Figure 2:
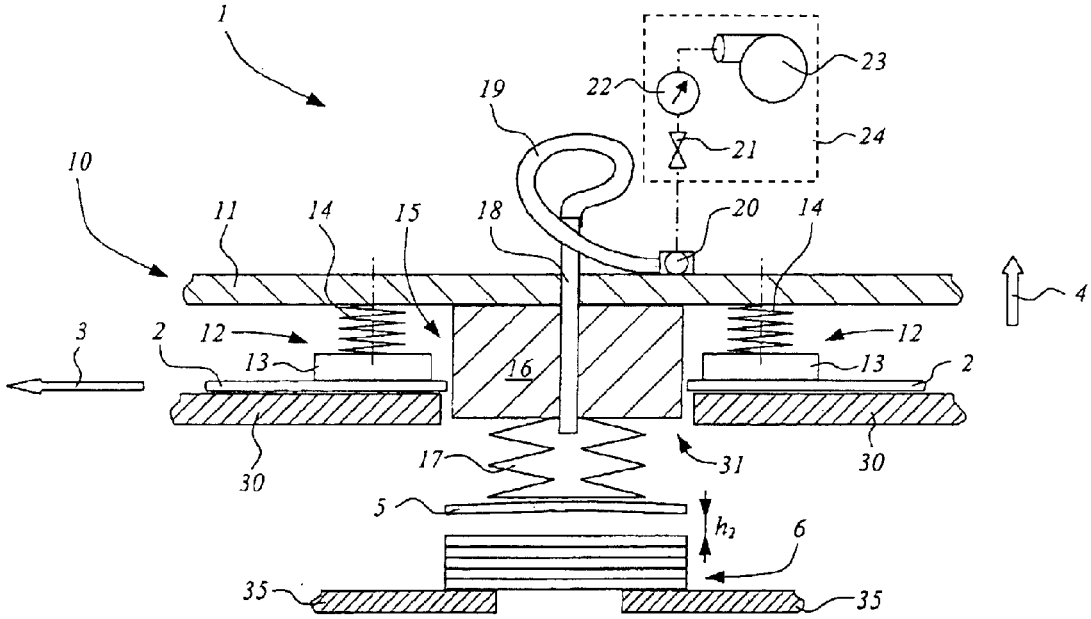
FIG. 2 is the same view of that device in a second situation close to the end of the blanking cycle.
Figure 3:
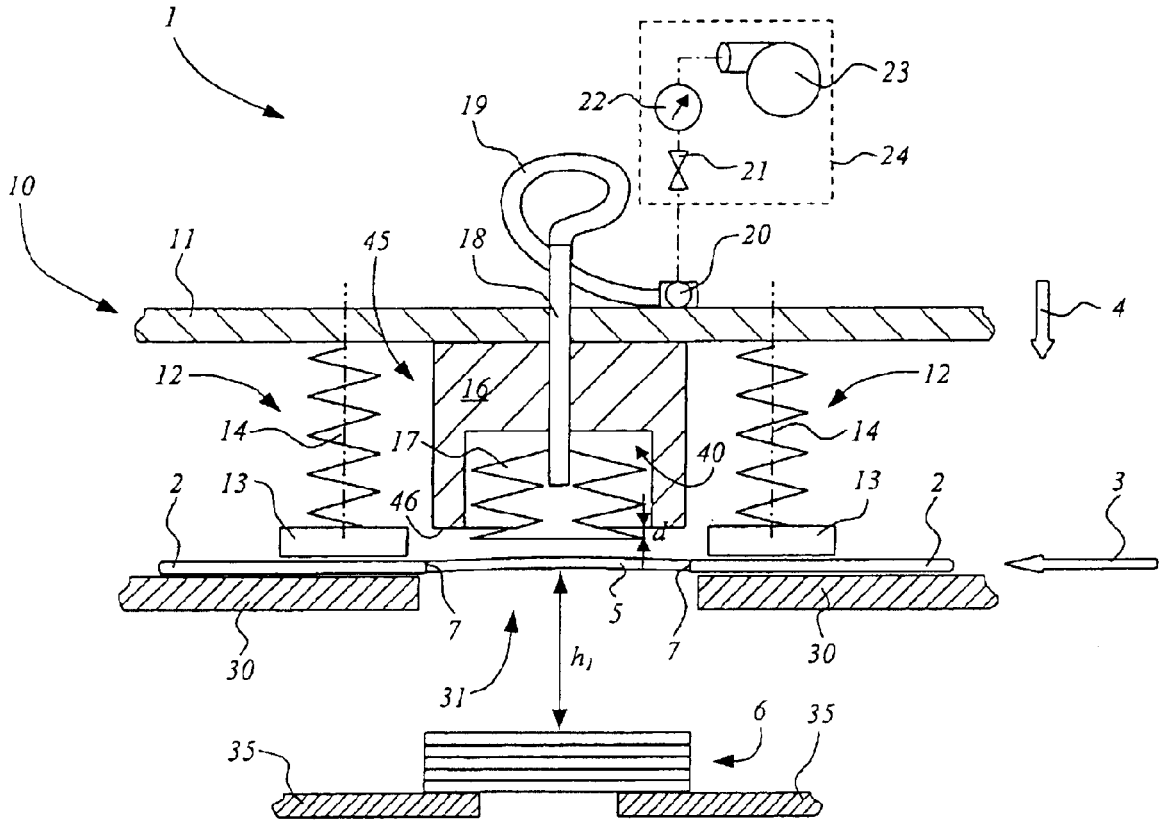
FIG. 3 is the same view of an alternative device to that of FIG. 1.

FIGS. 1 to 3 schematically represent blanking devices 1 of the present invention in a simplified illustration. Some dimensions of the constituting members have been exaggerated for drawing clarity and for a better understanding of the method of use.

FIG. 1 shows this device in a first situation corresponding to the beginning of a cycle which is continuously repeated in a blanking station and working with previously cut sheets 2. These sheets are fed inside the device in the direction of arrow 3.

Device 1 includes an upper tool 10 which moves in a vertical path as shown by arrow 4, an horizontal lower tool 30, on which the sheet 2 stops at the beginning of each cycle, and a palette 35 which receives cut off blanks 5 in order to form a pile 6. The upper tool 10 and the lower tool 30 are of similar dimensions and corresponding to the size of sheet 2, the blanks of which have to be separated by ruptures at their attachment points 7.

The lower tool 30, which is also called lower board, includes openings 31 which are of slightly larger size to the size of blanks 5 to allow the blanks to easily pass through the openings. The first operation then is to position the sheet 2 for perfect alignment up between the blanks and the lower tool openings.

The upper tool 10 comprises a base plate 11, generally comprised of wood or of a synthetic material, having two faces on which are mounted various elements used in the blanking method. For this purpose, the elements are essentially pressing devices 12 and punches 15. In order to simplify FIGS. 1 to 3, only two pressing devices are represented on both sides of a single punch. Actually, there are at least as many punches 15 as there are blanks 5 in the sheet 2.

The pressing devices are intended to maintain the sheet against the lower tool 30 to avoid any movement of the sheet while the blanks are released from the skeleton of the remainder of the sheet. Each pressing device is generally comprised of a press element 13 located at the end of a telescopic axis, schematically represented here by a spring 14. The other end of the spring is fixed to the base plate 11. In another known realization, the pressing devices can be preferably comprised of parallelepidal blocks carved from compressible foam.

The separation of a blank 5 is realized by the punch 15, which is rigidly locked to the base plate 11 by a block 16 that ends with a suction cup 17. That cup is advantageously expansible and looks, for example, like a gusset. The block 16 of punch 15 and the base plate 11 of the upper tool are crossed by a tube 18. One end of the tube 18 runs inside the suction cup 17, whereas the other end extends into a tube 19. The tube is hung up to a canalization 20 disposed on the upper part of base plate 11. As schematically illustrated in the Figures, the canalization is connected to a vacuum source 23 through at least one valve 21 and at least one regulative or measuring member 22. Advantageously, these members allow measurement of some of the main characteristics of the air flow, such as its density, pressure and speed, for example. The vacuum source 23 is preferably arranged outside of the blanking station, above the machine, for example. Each punch 15 of the upper tool 10 is usefully connected to a canalization 20 and the combined canalizations form an air distribution network linked to a vacuum source 23 through at least one valve 21 and one or several regulating or measuring members 22.

As illustrated in FIG. 1, due to the starting of the suction process, the suction cup 17 is able to seize a blank 5 before the pressing devices 12 come into contact with the parts of the sheet adjacent to the blank. The blank is thus completely under control of the punch 15 before any other operation.

Control of the whole air distribution network is electronically or mechanically run with cams by a control unit 24, illustrated by a rectangle sketched with interrupted lines. An operator may act at any time on the suction device through this control unit. This unit could be materialized by a control bracket which allows display of and thus knowledge of the suction flows parameters and allows consequent action, if necessary, to adjust the flow. It could also be possible to memorize the various used adjustment parameters with respect to the various works realized in the blanking device.

FIG. 2 represents the device of FIG. 1 at a later time in the cycle of blanks separation. Between the times represented in these Figures, once blank 5 is under the control of the punch 15 by air suction through the suction cup 17, the pressing devices 12 rest on the sheet 2 very near to the opening 31. The continuous downward motion of the upper tool 10 compresses the gusset of suction cup 17 progressively until the compressing force exceeds the mechanical resistance of the attachment points 7. From this moment, the blank is not released ahead in a sudden manner. Instead, it stays under the control of punch 15, which, continues going down to the pile 6. Once the punch has arrived at the lowest level of its path, the punch releases the blank 5 due to pressurization of suction cup 17 directed by the unit of control 24 and to the release of air in tubes 18. At that point, the height of fall $h_2$ of blank 5 to the top of the pile is minimal (e.g. around 20 to 30 mm). In comparison, the break of attachment points 7 takes place at a height $h_1$ that is much higher above the pile (e.g. around 65 mm).

Once suction cup 17 is separated from the blank 5, the upper tool 10 rises as illustrated by arrow 4 in FIG. 2, until the pressing devices 12 separate from the remaining part of sheet 2 and the lower part of the suction cup 17 reaches at least the top of sheet 2. Then the top sheet can be released from the blanking station, in the direction indicated by arrow 3. A new cycle can thus begin again as soon as the new sheet 2 arrives. As the pile 6 increases, the palette 35 moves down to maintain the upper surface of the pile at a constant level, for keeping the height of fall $h_2$ also preferably constant.

FIG. 3 represents an alternative to the same device in a slightly different configuration. There is another type of punch 45 comprising a block 46 which includes a space 40 allowing folding of suction cup 17 inside of this space. In this arrangement, only a very slight distance d separates the lower part of the suction cup 17 from the lower part of block 46. With a gusset that is soft enough, suction cup 17 can completely collapse within space 40 when punch 45 begins to push on blank 5, even before the attachment points of the blanks break. Therefore, while it comes into contact with the blank 5, the lower surface of block 46 bends blank 5 down until the rupture of attachment points 7 that link it to sheet 2. Because it is maintained under constant suction, the fall of blank 5 remains under the control of punch 45 until the unit of control 24 commands interruption of the suction flow and again permits the air to go in canalization 20.

This configuration has the pressing devices come into contact with the sheet 2 before the suction cup 17 of punch 15 seizes blank 5 by suction. The remaining process is realized as described above, from the moment the punch begins to go down and in the opposite direction, when the upper tool 10 moves up.

Whatever may be the chosen configuration, the diameter of the canalization of the air distribution network is related to the surfaces of the blank and their quantity by sheet. The power of the suction source is adapted in relation to the task to be done. But, various tests have shown that the regulation members 21 had a sufficient setting zone to cover the totality of the needs.

Although not excluded, it is not planned to reverse the pressurization in the canalizations to inject an air flow into the suction cup so as to faster release the blank from the lower surface of the suction cup. However, this could be useful with very small blanks, and/or very light ones and with a slightly too sticky surface. Indeed, such a blank could present some difficulty for naturally separating it from the suction cup only under a gravitation pull. In this case, the vacuum source 23 could be converted into a compressed air source 23, by a simple polarity reversal in its constituting engine.

It could also be possible to cut the suction effect in the suction cup during the period between the break of the attachment points and the lowest point in the course of upper tool 10. In this case, the favorable effect of the blank control during its release from the sheet would still be kept and this blank would never be released at a greater speed than that of the punch motion.

Tests in assembly shops have also shown that it is advantageous to use a gusset shaped or bellow shaped and therefore collapsible suction cup in contrast to the conventional suction cup as generally used in the suction units that introduce sheets in the production lines. Indeed, the advantage of the gusset suction cup and its expansible characteristics mainly lies in its ability to seize the blank in any case, even when the lower horizontal surface of the suction cup is slightly not parallel to the blank surface, or when the blank surface is not perfectly planar. However, it could be possible to use another type of suction cup arrangement in the blank separating device such as presented above.

The blanking method applied to this device thus preferably includes the following successive steps:

a) Lining up of blanks 5 of the pre-cut sheet opposite to the openings 31 of the lower tool 30;

b) Activating vacuum by suction cups 17 of punches 15;

c) Gripping of blanks 5 by suction cups 17 before the rupture of the attachment points 7 by punches 15.

d) Separating blanks 5 and controlling them by keeping suction cups 17 under low pressure during breaking of attachment points 7;

e) Modifying of the air pressure in suction cups 17 in order to release blanks 5 from suction cups 17;

f) Returning the upper tool 10 upward to its initial position; and g) Evacuating sheet 2 outside of blanking device 1.

In this process, It is also important to note that a step could be added, in that the pressing devices 12 contact the sheet 2 either before the grip of the blanks by the suction cups or after this grip.

The arrangements of the various members of the device related to the present invention have been very schematically illustrated in the Figures and the invention is not limited to such illustrations, but can include various improvements presented in the claims.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A blanking method for blanking a plate-like blankable sheet which has been cut in several blanks that are maintained together with the sheet by a plurality of nicks, the method comprising:

positioning the previously cut blanks above openings defined in a lower blanking device tool such that the blanks would fit through the openings;

activating suction in suction devices of punches above each of the blanks such that the suction devices would hold the blanks to the punches;

gripping the blanks by the suction devices of the punches; while gripping the blanks, moving the punches of an upper blanking tool toward the openings in the lower tool for the punches to break the nicks between the blanks to separate the blanks from the sheet, and controlling the blanks being separated from the sheet by keeping suction in the suction devices during the rupturing of the nicks;

after rupturing of the nicks with the punches in the openings, changing air pressure at the suction devices to release the blanks from the suction devices so that the blanks might fall on a pile;

then moving the upper tool up out of the openings.

2. The method of claim 1, further comprising moving the sheet, from which the blanks have been separated, outside the position over the openings in the lower tool.

3. The blanking method of claim 1, further comprising pressing the sheet on the lower tool outward of the blanks during the moving of the punches into the openings in the lower tool.

4. The method of claim 3, contacting the sheet by the pressing devices after the blanks have been gripped by the suction devices.

5. The method of claim 1, wherein the changing of the air pressure at the suction devices comprises equalizing the pressure value in the suction devices with that of the surrounding pressure.

6. The method of claim 1, wherein the changing of the air pressure in the suction devices comprises increasing the pressure at the suction devices to be above the value of the room pressure surrounding the device.

7. The method of claim 1, wherein the suction devices comprise collapsible cups which extend beyond the end of the punches, the method further comprising moving the collapsible cups into contact with the blanks before the punches contact the blanks and permitting the collapsible cups to collapse toward the punches until the punches engage the blanks.

8. A blanking device in a cutting machine for cutting plate-like elements from a sheet, wherein the elements had previously been shaped in several blanks in the sheet and the blanks are held together in the sheet by a number of nicks, the blanking device comprising:

a lower tool for supporting the sheet, the lower tool having a plurality of openings therein generally shaped, sized and positioned to the blanks on the sheet supported on the lower tool;

an upper tool, and the upper and the lower tools being movable toward and away from each other; the upper tool having a lower surface facing toward the lower tool;

a plurality of telescopable pressing devices at the lower surface of the upper tool positioned and adaptable for holding the sheet on the lower tool and so positioned at the upper tool as to engage the lower tool outward of the openings so as to not block the openings, the pressing devices being adapted to a telescope after contacting the sheet on the lower tool and while the tools are moving toward each other;

a plurality of punches supported at the upper tool on the side facing toward the lower tool shaped for engaging blanks supported at the lower tool with each punch being shaped to pass into the opening of the lower tool as the upper and lower tools move toward each other;

a respective suction device on each of the punches, and a suction source connected with the suction devices adaptable for selectively sucking to hold the blanks to the punches and selectively operable to release the blanks from the punches.

9. The blanking device of claim 8, wherein the lower tool is motionless while the upper tool moves toward and away from the lower tool.

10. The blanking device of claim 8, wherein each of the suction devices comprises a suction cup.

11. The blanking device of claim 10, wherein the suction cup comprises an expansible suction cup expansible and contractible respectively toward and away from the lower tool enabling movement of the upper and lower tools together before the upper tool contacts the sheet on the lower tool.

12. The blanking device of claim 11, wherein the punch has a lower end which contacts the sheet and at least part of the suction cup projects below the lower end of the punch.

13. The blanking device of claim 8, wherein the suction source to the suction device selectively comprises a vacuum source or a pressure source selectively able to generate changes in the air pressure within the suction device, and a distribution network for the vacuum source and the pressure source.

14. The blanking device of claim 13, wherein the distribution network for the vacuum source or pressure source is located above the upper tool.

15. The blanking device of claim 13, wherein the distribution network includes a valve for air control and an air regulation or measuring member.

16. The blanking device of claim 15, further comprising a control unit for operating the distribution network and the vacuum or pressure source.

* * * * *